US011396084B2

(12) United States Patent
Mestanek et al.

(10) Patent No.: US 11,396,084 B2
(45) Date of Patent: Jul. 26, 2022

(54) MULTI-JET ABRASIVE HEAD

(71) Applicants: PTV, spol. s.r.o., Hostivice (CZ); Institute of Geonics of the CAS, Poruba (CZ)

(72) Inventors: Jiri Mestanek, Repy (CZ); Zdenek Riha, Kohoutovice (CZ)

( * ) Notice: Subject to any disclaimer, the term of this patent is extended or adjusted under 35 U.S.C. 154(b) by 739 days.

(21) Appl. No.: 16/299,190

(22) Filed: Mar. 12, 2019

(65) Prior Publication Data

US 2019/0283213 A1 Sep. 19, 2019

(30) Foreign Application Priority Data

Mar. 13, 2018 (CZ) ..... CZ2018-124

(51) Int. Cl.

| | |
|---|---|
| ***B24C 5/04*** | (2006.01) |
| ***B24C 1/04*** | (2006.01) |
| ***B24C 7/00*** | (2006.01) |
| ***B24C 5/02*** | (2006.01) |

(52) U.S. Cl.

CPC ..... *B24C 5/04* (2013.01); *B24C 1/045* (2013.01); *B24C 5/02* (2013.01); *B24C 7/0007* (2013.01); *B24C 7/0076* (2013.01)

(58) Field of Classification Search

CPC ... B24C 7/0084; B24C 7/0076; B24C 7/0038; B24C 5/04

See application file for complete search history.

(56) References Cited

U.S. PATENT DOCUMENTS 4,478,368 A * 10/1984 Yie ..... B05B 7/1431 239/430

6,280,302 B1 * 8/2001 Hashish ..... B24C 5/04 451/102

* cited by examiner

*Primary Examiner* — Joel D Crandall

(74) *Attorney, Agent, or Firm* — Cionca IP Law P.C.; Marin Cionca

(57) ABSTRACT

Multi-jet abrasive head for cleaning/removing material surfaces and splitting/cutting materials by a liquid beam enriched with solid abrasive particles with a uniform velocity and density profile allowing the cutting power to be increased with more efficient cutting beam usage.

11 Claims, 9 Drawing Sheets

MULTI-JET ABRASIVE HEAD

CROSS-REFERENCE TO RELATED APPLICATIONS

The present application claims priority from Czech patent Application No. PV 2018-124 filed on Mar. 3, 2018, the entire contents of which are incorporated herein by reference.

FIELD OF TECHNOLOGY

The technical solution falls within the hydraulics area. The patent subject-matter is a tool to clean/remove material surfaces and split/clean materials with a liquid beam enriched with solid abrasive particles.

STATE OF THE ART

The abrasive head with gas and abrasive intake currently in use is composed only of single liquid jet, mixing chamber and abrasive jet. The above-mentioned components are positioned one after another in the tool axis in a way that the high-speed liquid beam formed by a liquid jet passes all along the tool axis. The liquid jet is designed to convert pressure energy into kinetic energy, thus creating the above-mentioned high-speed liquid beam. The thin liquid beam passes through the center of the tool or other abrasive head's parts. The beam movement though the mixing chamber center results in gas and abrasive intake into the mixing chamber. The gas and abrasive particles are accelerated here by the high-speed liquid beam motion. Water may be used as the liquid here. Air may be used as the gas here. The created mixture of liquid, gas and abrasive particles flows on to pass through the abrasive jet center. Further acceleration of the gas and abrasive particles is made by the action of the high-speed liquid beam flowing in housing interior of the abrasive jet, which is largely formed by an input cone linked with the upstream mixing chamber shape and a long cylindrical opening.

Figure 8A:
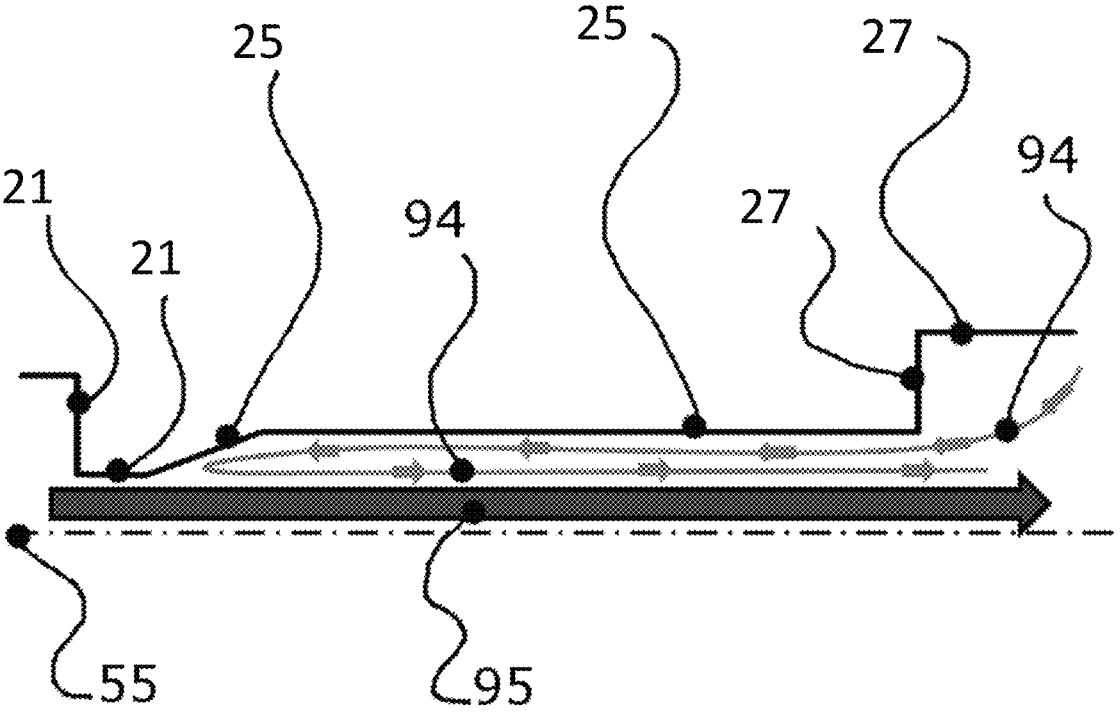

A high-velocity profile of the described mixture of liquid, gas and abrasive particles is created in the abrasive head's cylindrical section. The disadvantage of the current solution such as patents EP2853349A1, EP0873220B1 or US2016/0129551A1 is a strongly center pattern of the velocity profile. The Czech application of invention CZ PV 2014-754 describing the abrasive head in a classic layout with an emphasis on the mixing chamber geometry faces a similar problem. The mixing chamber shape is designed in a way to minimize the degradation of abrasive particles. This increases the cutting efficiency. With all the jet head layouts known so far, the highest velocity of the particles is reached in the center of the abrasive jet cylindrical section where the liquid beam is located. The mixture velocity then decreases rapidly towards the abrasive jet cylindrical section wall. This velocity profile shape is determined by distribution of the mixture itself the in abrasive jet cylindrical section. The velocity profile shape of the single-jet abrasive head is rotationally symmetric with a significant peak around the tool_axis. As already said, the liquid beam passes though the center of the abrasive jet cylindrical section. The gas flows around the abrasive jet cylindrical section walls. An abrasive particle located near the cylindrical section's center is then efficiently accelerated to a very high velocity (700 m per second or more). An abrasive particle located near the abrasive jet cylindrical section's wall is then accelerated significantly less (to a velocity of 150 m per second and lower) with almost no contribution to the effective cutting process. These particles accelerated to lower velocities then decrease the relevant abrasive head's own cutting efficiency. The described central velocity profile of the mixture with the stated mixture density distribution having its maximum density in the cylindrical opening axis appears to be disadvantageous from the cutting efficiency angle. A significant disadvantage of current solutions is also the recirculating gas flow built as the liquid beam is passing through the tool. The recirculating flow often carries the abrasive particles up to the liquid jet, thus damaging it along with the equipment other parts. This phenomenon is visualized on FIG. 8A.

The DE 2 928 698 document presents a close technological status. This document describes an equipment which may contain more liquid jets whose beams, however, intersect only in the mixing chamber. The mixing chamber is filled with the supplied abrasive material being entrained by incoming liquid beams. The separated liquid beams capture the abrasive particles, thus conveying their kinetic energy into them. At the intersection point of individual liquid beams, the liquid beams are being bent into one common liquid beam. However, abrasive particles have so much energy that they do not change their direction at the intersection point, continue to move directly and hit the mixing chamber walls, which results in a fast degradation of the abrasive particles as wall as a fast damage to the mixing chamber. The degradation of the abrasive particles involves also a rapid decrease in the cutting power and accuracy of such equipment.

The EP 1527820 document describes a component after being inserted in the jet head with two symmetrically positioned holes. Further documents representing general technological status include for example CN 2504037 Y or CN 206967310 U.

DESCRIPTION OF THE INVENTION

A new tool was developed to split/cut materials with a liquid beam enriched with solid abrasive particles with a more uniform flat velocity profile and a uniform density profile of fluid and abrasive mixture in the abrasive jet cylindrical cross-section, while the lowest velocity of the abrasive particles at the abrasive head/jet outlet is greater than 150 m per second with over 100 MPa liquid pressure before the liquid jets. With such tool, the cutting power is increased several times. The improvement in the velocity and density profile shape of the mixture passing through the abrasive jet is achieved by engaging more liquid jets in the tool. Using multiple liquid jets compared to a conventional single jet makes the mixture velocity profile vectors to be more flat, not rotationally symmetric, with less share of delaying layers at the abrasive jet cylindrical wall. The liquid beams in the tool interfere, bending relative to each other at the common intersection, thus creating a new common beam whose velocity profile cross-section may have a star-like shape with the number of corners corresponding to the original liquid beams or liquid jets.

Design Description

In direction from the pressurized water infeed up to the abrasive jet—downstream—the tool consists of at least two liquid jets, while each liquid jet has the benefit of being connected to the infeed channel, infeed channels of individual jets or individual liquid jets then lead to a single common channel which leads into the mixing chamber in the end of which the abrasive jet is connected. At least two gas and abrasive mixture infeeds lead into the mixing chamber. The infeeds of gas and abrasive mixture have the benefit of being connected to the gas and abrasive mixture distributor. The infeed or common channel has the benefit of being equipped with a clean gas infeed.

There are at least two liquid jets in the tool with no limits to their maximum number. By engaging more liquid jets, a more uniform velocity profile as well as a uniform abrasive and fluid mixture density profile within the beam cross-section are reached. The liquid jets in the tool are positioned symmetrically around the tool longitudinal axis (hereinafter only "the tool axis"), proximately linking to the infeed channels or lead into the common channel. The liquid jet axis is parallel to the infeed channel axis, being directed to the tool axis under a certain angle, i.e. the angle between the tool axis and the liquid jet axis (hereinafter only "the jet axis") or the infeed channel axis. The inclination is designed in angles between 0.5° to 45°, while the symmetrically positioned liquid jets including the infeed channels in one set must have the same inclination. Ideal tool constructions work with inclinations having to benefit to range between 2° and 25°.

The liquid jets are located around the tool axis in sets, each with a rotational symmetry and the same inclination relative to the tool axis, with one jet set containing at least two or three jets in one tool depth on a single circle lying in the plane normal to the common beam flow direction.

It is possible, for example, to position five jets in a single set with all five jets being placed in a rotationally symmetric pattern with the same inclination under the condition that the liquid beams in the set of all five jests have the equal volume flow rates. This will ensure mutual bending of the liquid beams and the creation of a mutual beam while minimizing the loss energy.

Or, three jets may be positioned in a row in a rotationally symmetric pattern with the same inclination or two jets may be positioned with less inclination in a rotationally symmetric pattern or against each other, with both sets being positioned in one depth relative to the flow direction. This is under the condition that the liquid beams from one jet set have equal volume flow rates. This will ensure mutual bending of the liquid beams, i.e. three into a common beam and then two into the already made beam, because with the lower inclination, the intersection is reached later in the flow direction provided that the two jets from the other set make a sharper angle with the tool axis than the first three-jet set.

Or, three jets with a given inclination may be positioned in the first row and depth in a rotationally symmetric pattern and another two jets with the same inclination may be positioned downstream in the second row and depth. Again, this is under the condition that the liquid beams from one jet set have equal volume flow rates. This will ensure mutual bending of the liquid beams into a common beam, i.e. the three beams first, then another two lower downstream that merge with the already flowing common beam later downstream.

Thus, the liquid jets are positioned in the tool by sets, while there are at least two jets in a single row with equal liquid volume flow rates, equal inclination relative to the tool axis, they are positioned in the same depth, i.e. at equal distances from the abrasive jet outlet and they are positioned in a rotationally symmetric pattern around the tool axis or against each other. Various jet sets may have the same of different inclination and the same or different depth. The axes of individual liquid jets and the infeed channels meet each other and the tool axis at the common infeed channel at a single or multiple common points—intersections where bending and interference of the liquid flow beams occur, while the intersections are located at the common channel before the mixing chamber entrance. The intersection number depends on the number of the liquid jet sets, their position depth within the tool and and inclination of the liquid jets with infeed channels as the jets from two different sets at different tool depths may have just one intersection determined by the jet inclination angles in both sets. Increasing the inclination shortens the distance to reach the intersection.

Figure 8B:
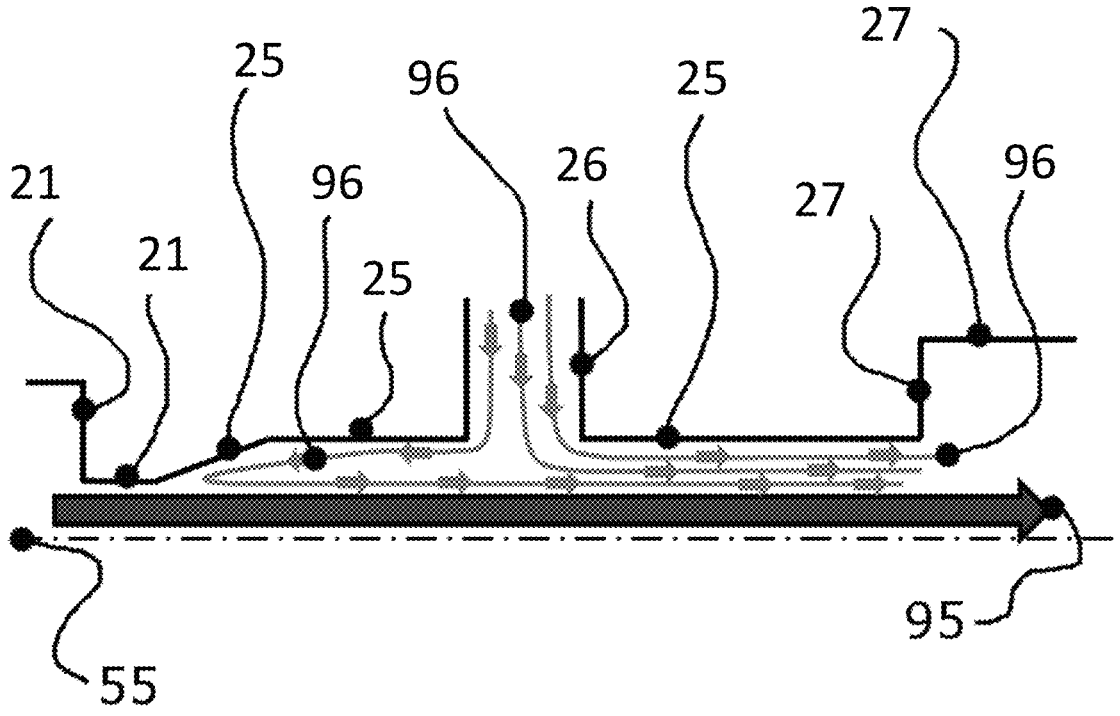

Another great benefit leading to a significant increase in the tool lifetime is the engagement of clean gas infeeds in the infeed channels to merge with the liquid beam flow coming from the liquid jet. These gas infeeds make the gas intake into the tool, thus eliminating unwanted air recirculation along with the particles of the abrasive itself that harm the tool's internal components and mainly the liquid jet. The recirculation is shown on FIG. 8 with FIG. 8A describing gas and abrasive upstream recirculation up to the liquid jet in case when no clean gas infeed is installed, while FIG. 8B shows clean gas flow through the channel downstream the liquid beam flow which eliminates backward recirculation of gas and abrasive by filling the entire channel. Thus, clean gas supply into the infeed channels is made separately before the abrasive infeed.

Also, the common channel in the tool with clean air intake has the benefit of being tapered downstream before the mixing chamber while the sum of the liquid jet infeed channel diameters is equal or greater than the outlet diameter of the common channel leading into the mixing chamber and the outlet diameter of the tapered common channel is smaller than the outlet diameter of the abrasive jet cylindrical section. At least two gas and abrasive mixture infeeds lead into the mixing chamber. The mixing chamber merges into the abrasive jet. The common channel outlet diameter has the benefit of being equal or smaller than the abrasive jet cylindrical section. If the common channel's outlet diameter is smaller than the abrasive jet cylindrical section diameter, there is automatic intake of the gas and abrasive mixture into the mixing chamber thanks to the formed suction. If the outlet diameter of the common channel is equal or greater than the abrasive jet cylindrical section diameter, the gas and abrasive mixture must be supplied into the mixing chamber by boosting.

In a tool not equipped with either clean air intake or common channel tapering, the abrasive can be intaken automatically also by boosting the gas and abrasive mixture.

Description of Multi-Jet Abrasive Head Operation

The liquid is being fed into the tool under pressure through the liquid jets. The liquid beam flows from the liquid jets into separated infeed channels while the fluid passing through the infeed channel has the benefit of clean gas intake. The clean gas intake eliminated the recirculating flow of gas in the infeed channels. This avoids the abrasive being carried away by the recirculating gas flow upstream the liquid flow, thus eliminating damage to the liquid jets and head components by the abrasive particles.

Individual liquid beams being discharged from individual infeed channels flow into the common channel where the intersect depending on the inclination and positioning depths of the jet sets. For inclinations under 0.5°, it is necessary that the infeed channels should have long designs, which results in difficult tool handling. For inclinations over 45°, liquid expansion occurs at the intersection, which results in the beam velocity loss and filling the common channel with fluid with insufficient discharge velocity from the common channel. At each intersection, integration (interference) and bending of the liquid beams in the tool axis direction occurs. A common high-speed liquid beam then continues from the intersection into the mixing chamber along the tool axis. In the mixing chamber, the gas and abrasive mixture is entrained by the high-speed liquid beam. If the outlet diameter of the common channel is smaller than the abrasive jet cylindrical section diameter, automatic intake of gas and abrasive mixture occurs. The liquid beam along with the abrasive particles continues to flow into the abrasive jet and out of the tool. The high-speed beam treated in this way has a uniformly distributed velocity and density profile within the abrasive jet's circular flow cross-section. The integration of given liquid beams makes them spread over the entire abrasive jet's flow cross-section and the overall velocity profile becomes flat. This results in accelerating also those abrasive particles that move near the abrasive jet cylindrical wall to velocities significantly exceeding 150 m per second. The described fact results in up to triple increase in the cutting power for a three-jet abrasive head. The cross-section of such tool's velocity profile has an equal star shape. The number of star corners corresponds to the number of the tool's liquid jets.

In case a of multi-jet layout of the abrasive head, the air and abrasive particle mixture intake is performed in the mixing chamber, i.e. downstream after the intersection. If there was a contact between the abrasive particle and the liquid beam downstream before the intersection, the abrasive particle would receive trajectory and high kinetic energy from the liquid beam aiming at the tool axis under an inclination. At the intersection, the liquid beams interfere and bend as opposed to accelerated abrasive particles. These continue along the inclined trajectory relative to the tool axis gained from the liquid beam before the interference. The abrasive particles moving slantwise relative to the tool axis then hit the tool walls, which results in a very fast degradation of the abrasive head's key components as well as the abrasive particles themselves, leading to a significant decrease in the tool's cutting power.

Tool Design Implementation

The tool design should be selected with respect to the tool load level. Stressed tool components, supporting housings and jets may be made of hard metal or high-strength abrasive-resistant steel (such as 17-4PH, 17022, 1.4057 or 17346 steel etc.) and it's recommended to select high-strength materials such as diamond or sapphire for the jets. For connections and unstressed tool parts, it's possible to select less resistant materials such as PVC.

It's useful when the tool is made of a supporting housing in which the inner housing is inserted with the channels routed from the liquid jets to the common channel or the mixing chamber. The pressurized water connection is located on the top part of the supporting housing. The liquid jets housings are located inside the inner housing. More components can be connected to the inner housing using threaded joint, press joint or other permanent or demountable method. The abrasive jet housing is placed at the bottom of the supporting housing. As a benefit, the abrasive jet housing can be fixed in the supporting housing with a threaded joint or can be attached to the supporting housing via a collet with a nut. Between the inner housing or the inserted jet and the abrasive jet housing, there is the mixing chamber that may be a direct part of the supporting housing. The air and abrasive mixture can have the advantage of being fed through several symmetrically positioned connections.

The multi-jet tool's velocity profile is two to three times more uniform compared to a single water jet tool when the uniformity is measured according to the standard deviation of the liquid and gas mixture velocity profile at the abrasive jet outlet.

SUMMARY OF PRESENTED DRAWINGS

Figure 1A:
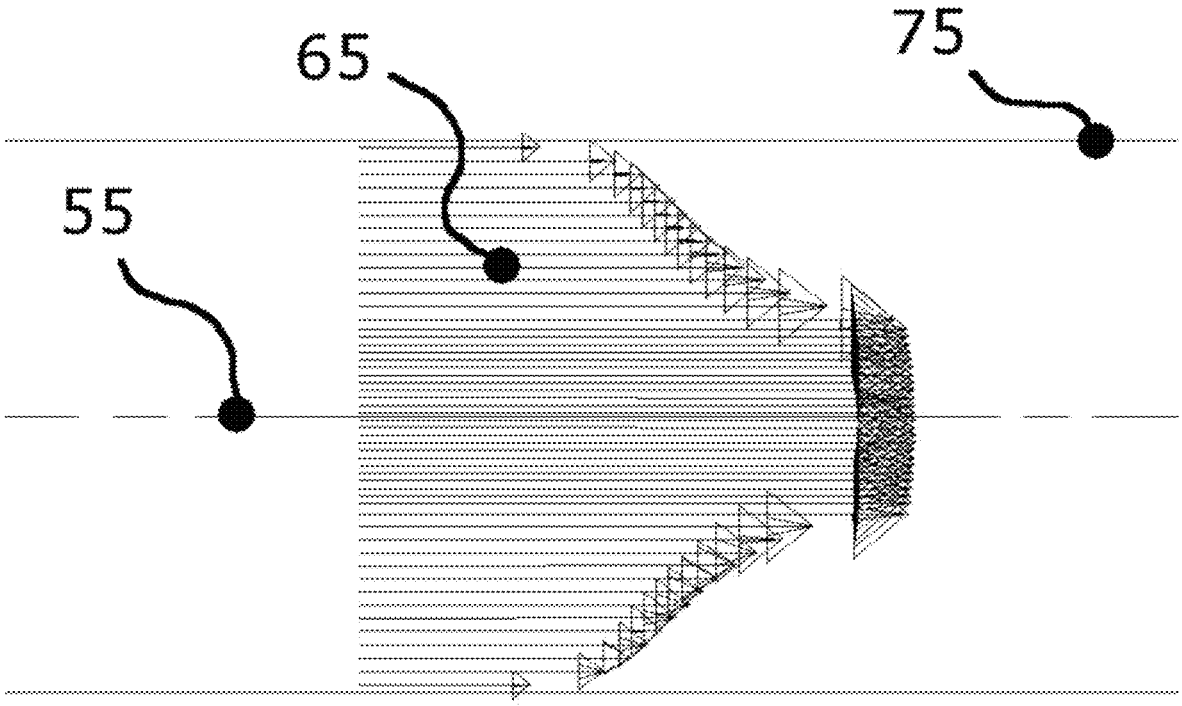
Figure 1B:
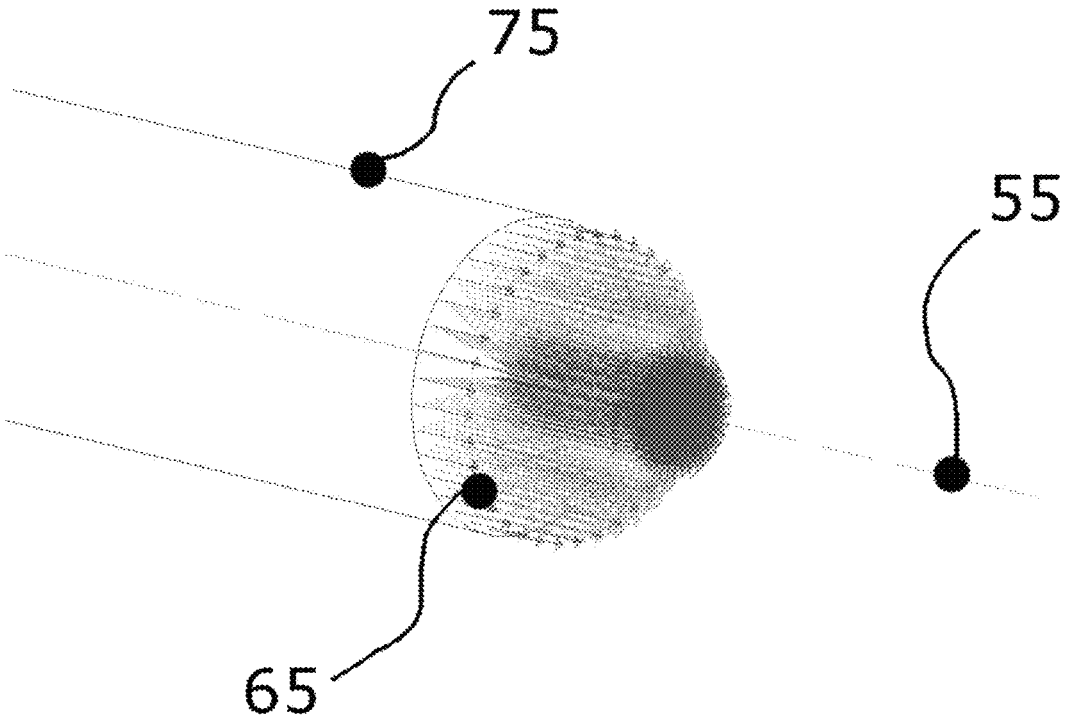

FIG. 1: A. Technology status. Velocity profile shape (longitudinal section) in the abrasive jet for the abrasive head with a single liquid jet.

B. Technology status. Velocity profile shape (cross-section) in the abrasive jet for the abrasive head with a single liquid jet currently in use.

Figure 2A:
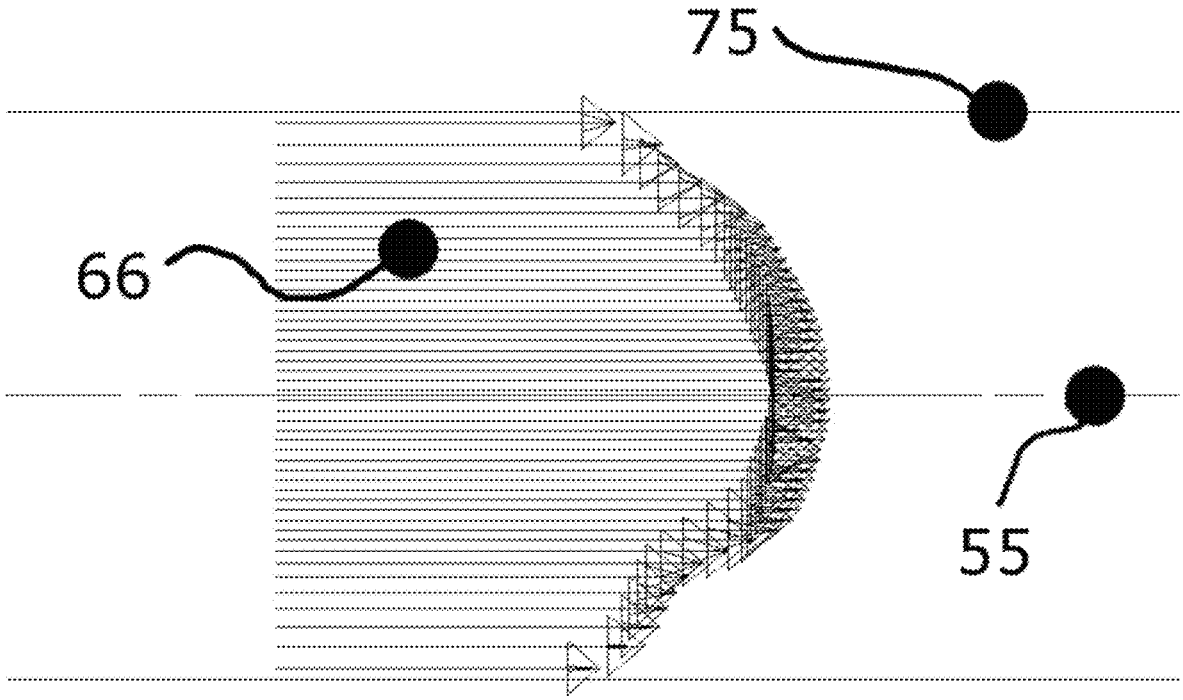
Figure 2B:
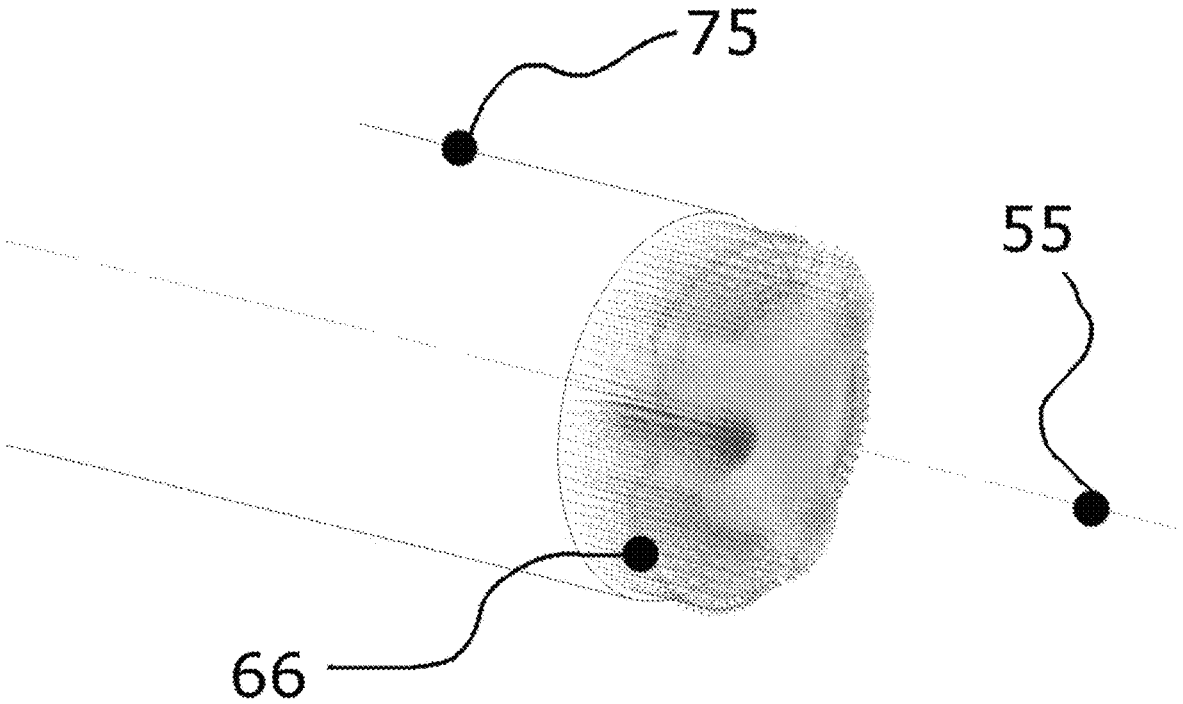

FIG. 2: A. Velocity profile shape in the abrasive jet (longitudinal section) for a tool with three liquid jets.

B. Velocity profile shape in the abrasive jet (cross-section) for a tool with multiple liquid jets.

Figure 3A:
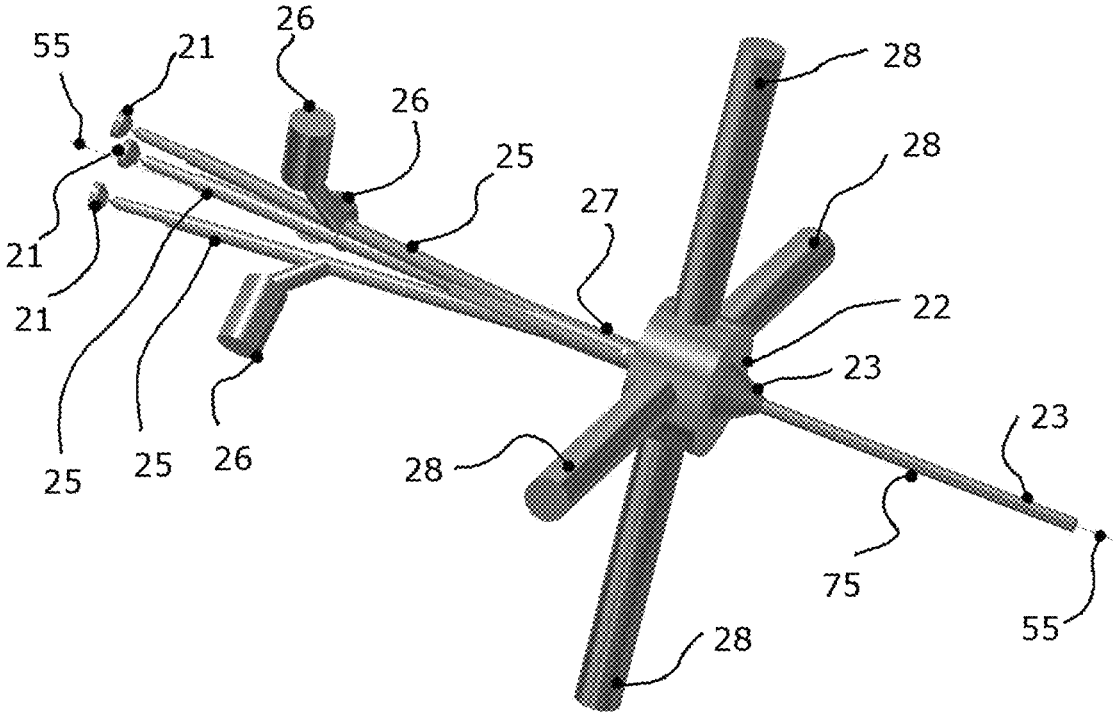
Figure 3B:
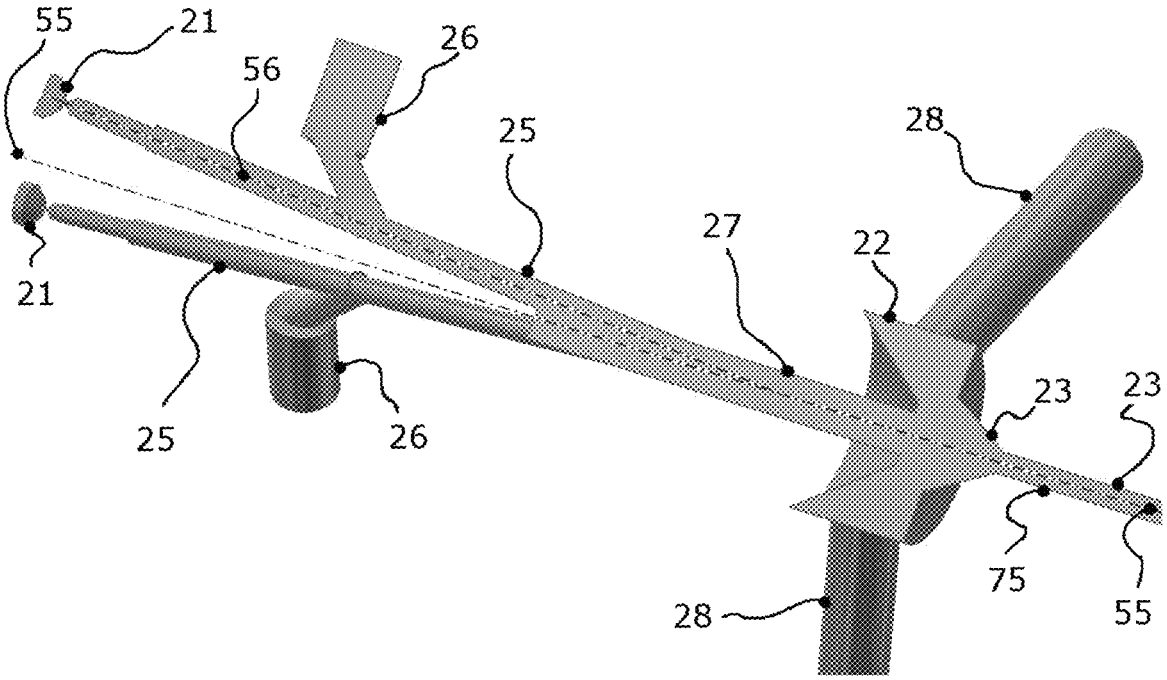

FIG. 3: A. Abrasive head according to example 1 with three liquid jets 21 with clean gas 96 infeed 26 through separated infeed channels 25 and four infeeds 28 of the gas and abrasive 94 mixture.

B. Detailed cross-sectional view of the tool with marked axes.

Figure 4A:
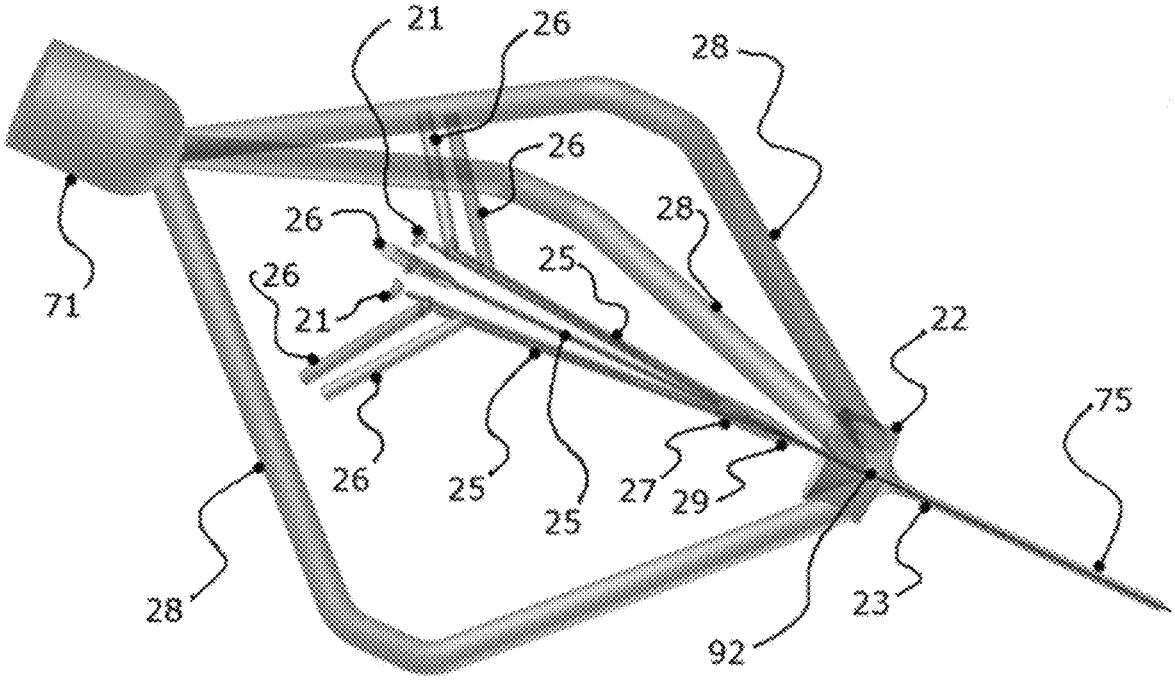
Figure 4B:
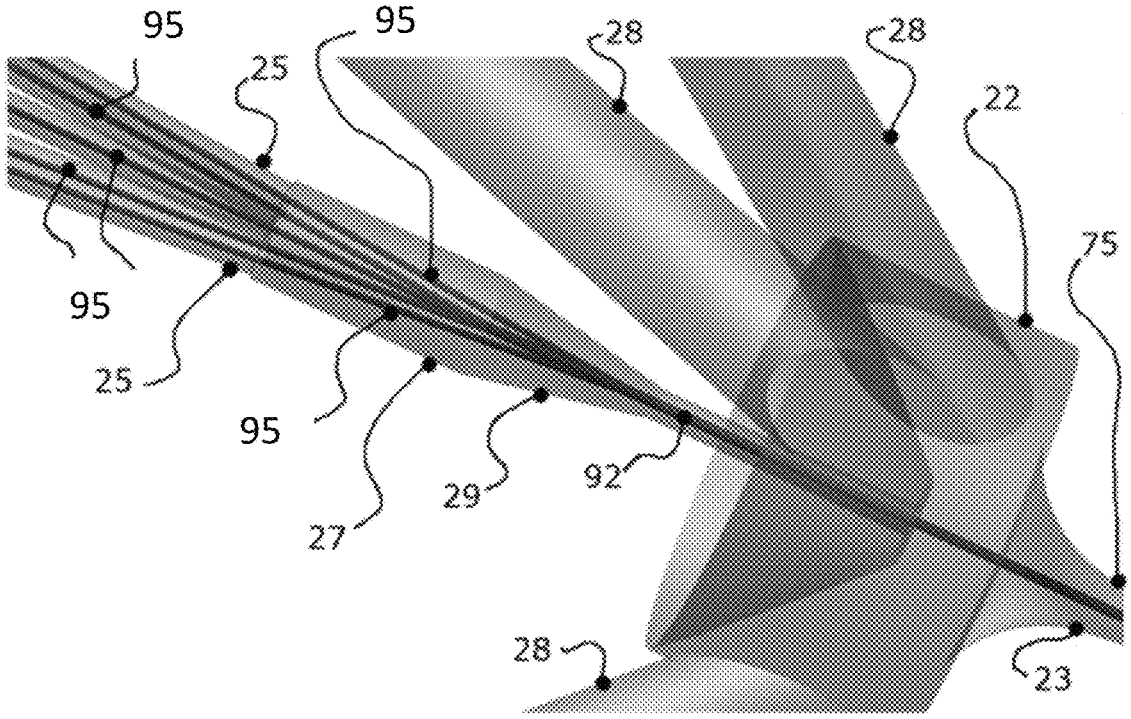

FIG. 4: A. Abrasive head according to example 3 with five liquid jets 21 in two sets with clean gas 96 infeed 26 through separated infeed channels 25 and three infeeds 28 of the gas and abrasive 94 mixture into the mixing chamber 22.

B. Detailed cross-sectional view of the tool with marked axes.

FIG. 5: A. Abrasive head according to example 2 with four liquid jets 21 and clean gas 96 infeed 26 through separated infeed channels 25 and four infeeds 28 of the gas and abrasive 94 mixture into the mixing chamber 22.

B. Detailed cross-sectional view of the tool with marked axes.

Figure 6:
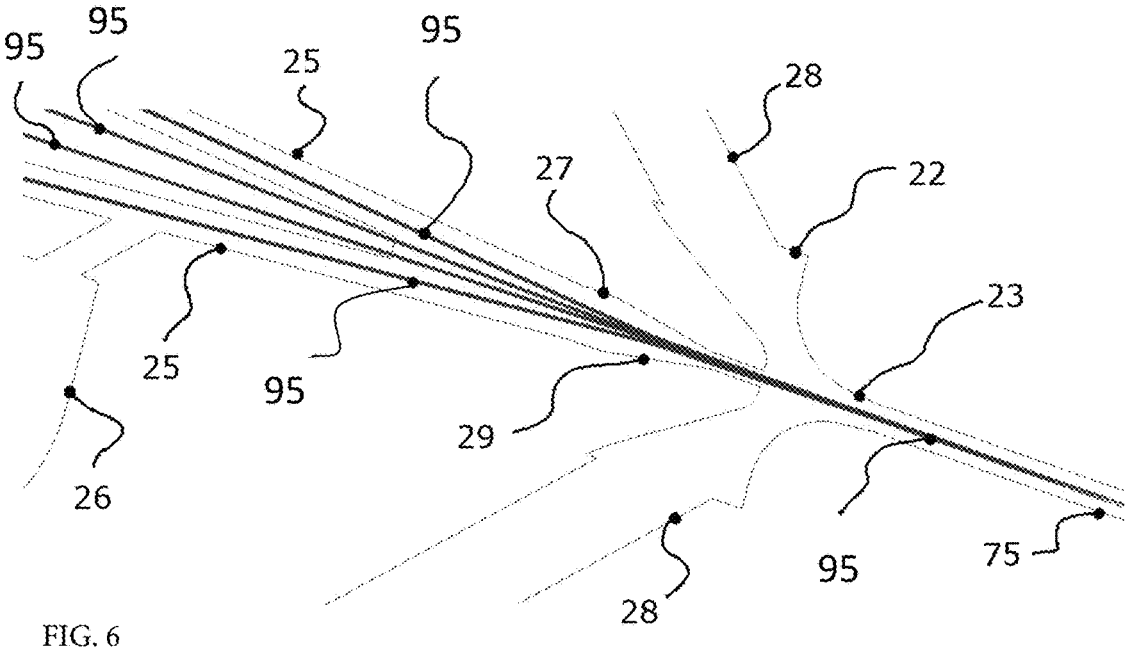

FIG. 6: Visualization of individual liquid beams 95 their intersection and the common beam for the tool design according to example 2 with four liquid jets 21 and four separated infeed channels 25.

Figure 7:
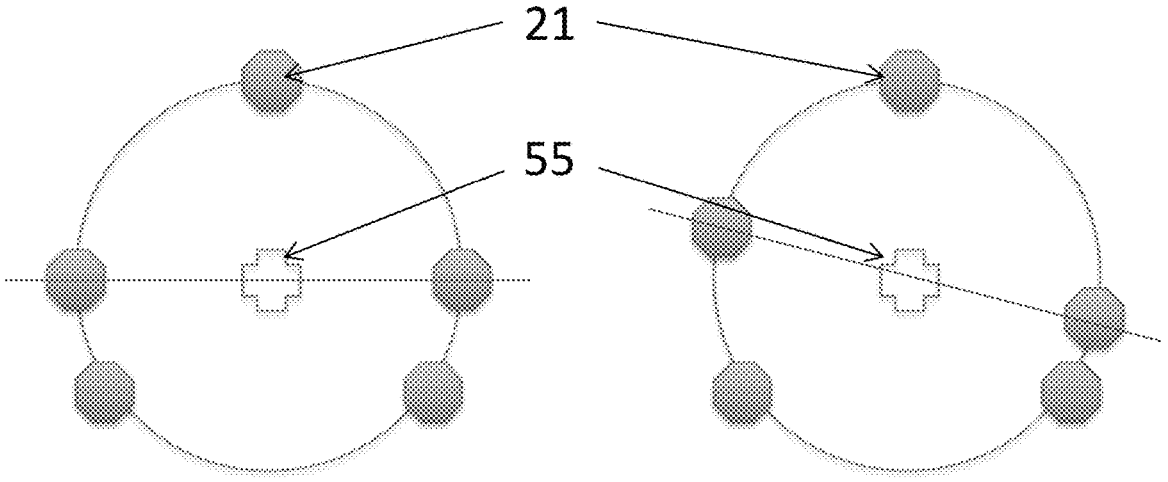

FIG. 7: Layout example of five liquid jets 21 relative to the tool axis 55.

FIG. 8: A. Technology status. A tool without separate clean gas infeed 96 with a single liquid jet 21.

B. Visualization of clean gas 96 flowing through channel 25 downstream the liquid beam flow 95.

Figure 9A:
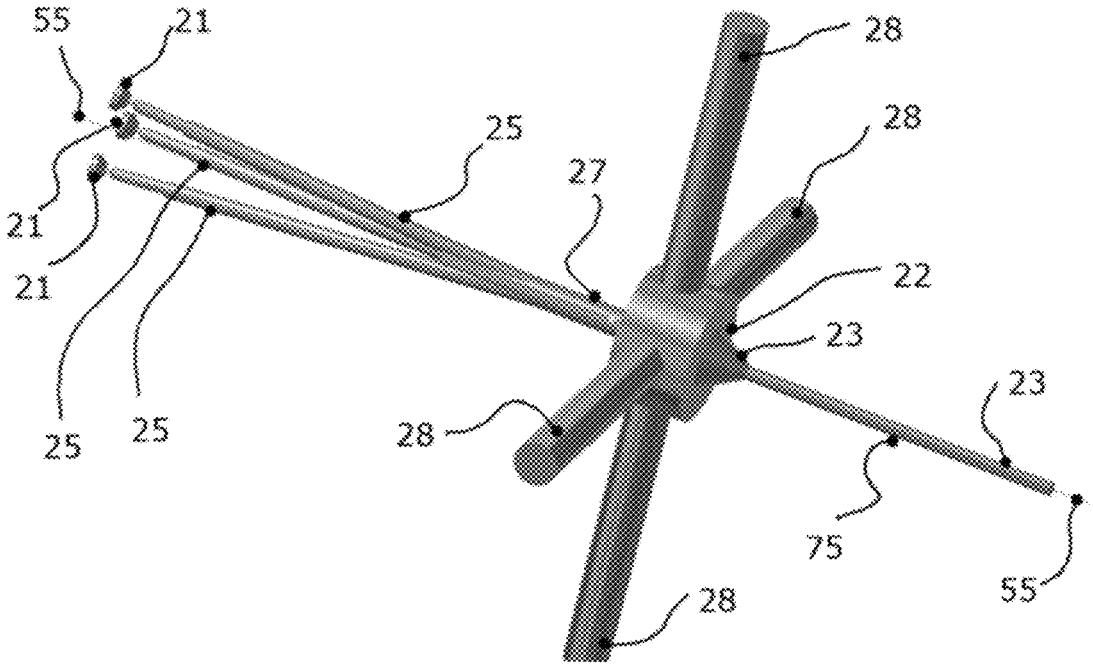
Figure 9B:
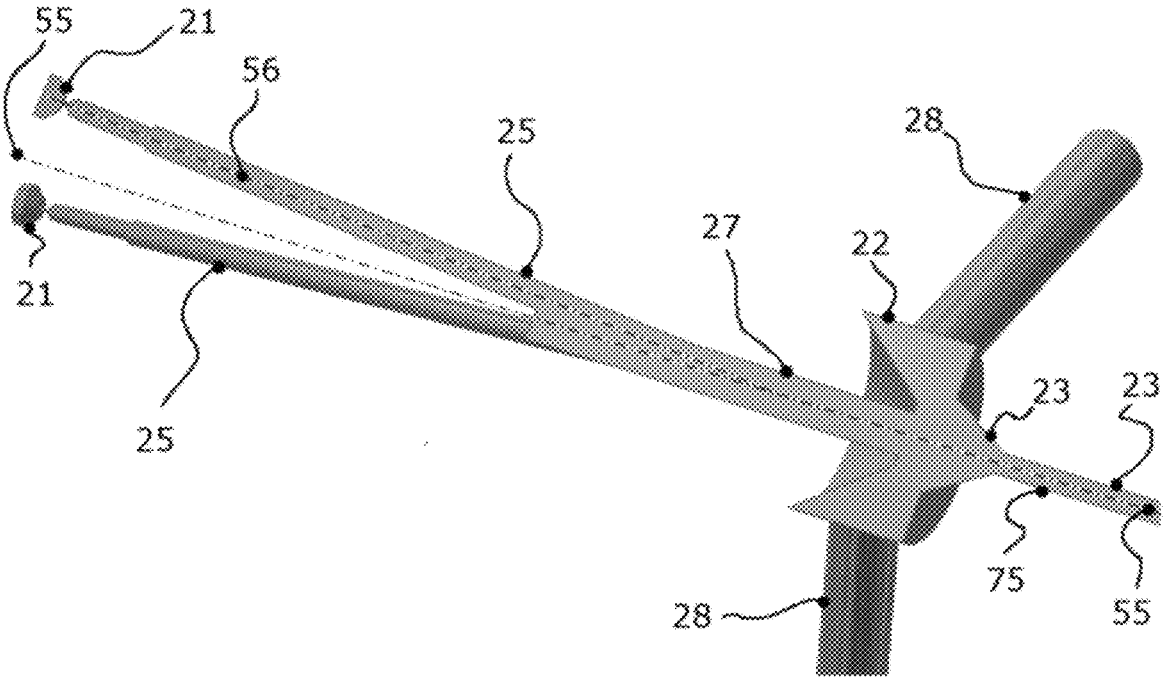

FIG. 9: A. Abrasive head according to example 4 with three liquid jets 21 with separated infeed channels 25 and four infeeds 28 of the gas and abrasive 94 mixture.

B. Detailed cross-sectional view of the tool with marked axes.

Figure 10:
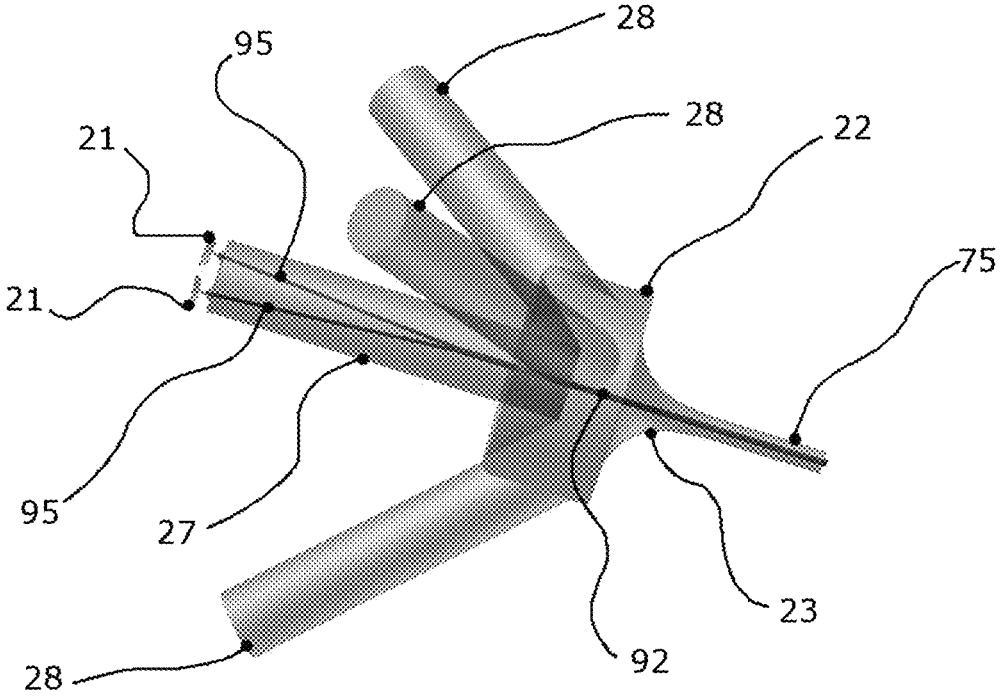

FIG. 10: A. Abrasive head according to example 5 with two liquid jets 21 leading directly to the common channel 27 and three infeeds 28 of the gas and abrasive 94 mixture.

EXAMPLES OF INVENTION EXECUTION

Example 1

An abrasive head with three liquid (water) jets and clean gas intake through separated infeed channels and four inputs of the intaken gas and abrasive mixture.

FIG. 3 shows an example of the tool design with three water jets 21, while the water jets 21 are positioned in a rotationally symmetric pattern around the tool axis 55 after the pressurized liquid infeed 71. The axes 56 of the water jets 21 and those of the separated infeed channels 25 make an angle of 8° with the tool axis 55. Each water jet 21 is connected to its own infeed channel 25 with a constant diameter which allows the high-speed liquid beam 95 to flow from a given water jet 21 into the intersection defined by the intersection 56 of the fluid jet axes 21 and the tool axis 55. Each infeed channel 25 is equipped with clean a gas 96 infeed 26, while the clean gas 96 is being automatically intaken into the separated infeed channels 25. Three separated infeed channels 25 merge into one common channel 27 with a constant diameter. At this point, individual liquid beams 95 merge into one common beam continuing along the tool axis 55 into the mixing chamber 22, to which the common channel 27 is connected. Four gas and abrasive mixture 94 infeeds 28 lead into the mixing chamber 22. The gas and abrasive mixture 94 enters the mixing chamber 22 through the infeeds 12 of the gas and abrasive mixtures 94 by boosting. The gas and abrasive mixture 94 accelerated by the common high-speed liquid beam 95 enters the abrasive jet 23 connected to the mixing chamber. The abrasive jet 23 is positioned in the tool axis 55 at the tool's end. At this point, further acceleration of the described mixture occurs before impacting on the cut material.

The abrasive head's supporting housing where liquid jets 21, mixing chamber housing 22 and abrasive jet housing 23 contains separated infeed channels 25, common channel 27 and is made of 17-4PH steel. The mixing chamber housing 22 is made of hard metal. The abrasive jet's housing 12 is also made of hard metal. Clean gas 96 infeeds 26 made of 17022 steel are connected to the abrasive head's supporting housing. Gas and abrasive mixture 94 infeeds 28 made of 17022 steel are connected to the abrasive head's supporting housing.

In case of a tool made according to example 1, there is no gas recirculation thanks to the presence of clean gas 96 infeeds 26 into the separated infeed channels 25. The cutting and velocity profile of such tool is very efficient thanks to the presence of three liquid jets 21, with the cutting profile having a three-corner star shape, the velocity profile of such tool reaches three times more uniform velocity distribution as opposed to the technology status—i.e. single-jet layout without separate clean gas 96 connections 26.

Example 2

An abrasive head with four liquid (water) jets and clean gas intake through separated infeed channels and four inputs of the intaken gas and abrasive mixture into the mixing chamber.

Figure 5A:
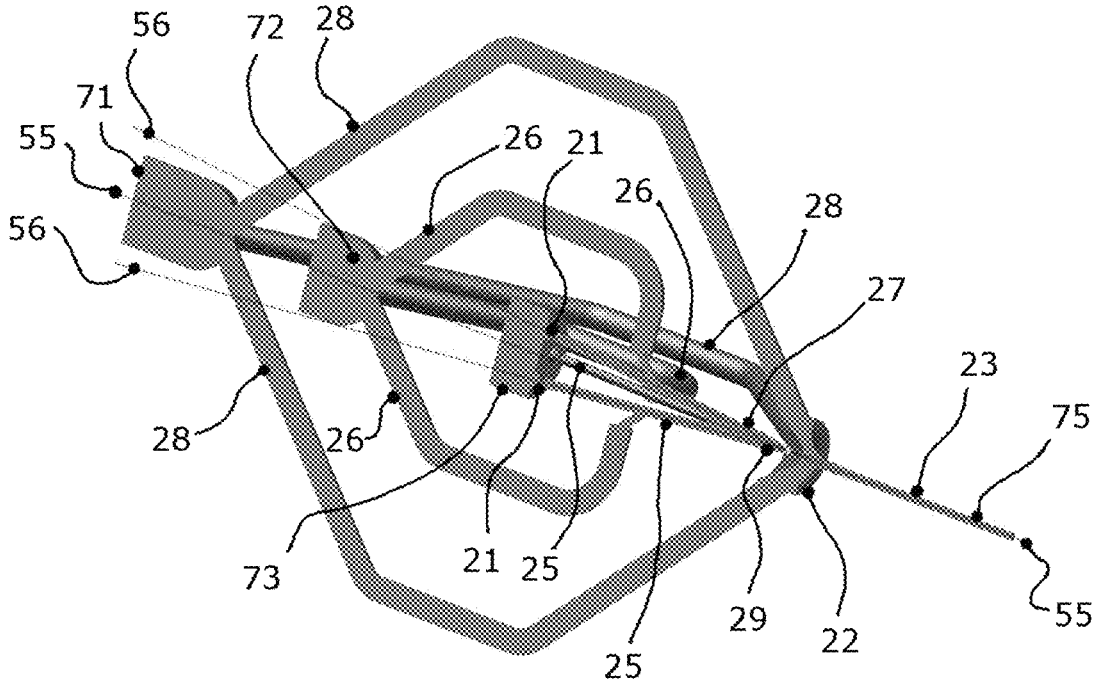
Figure 5B:
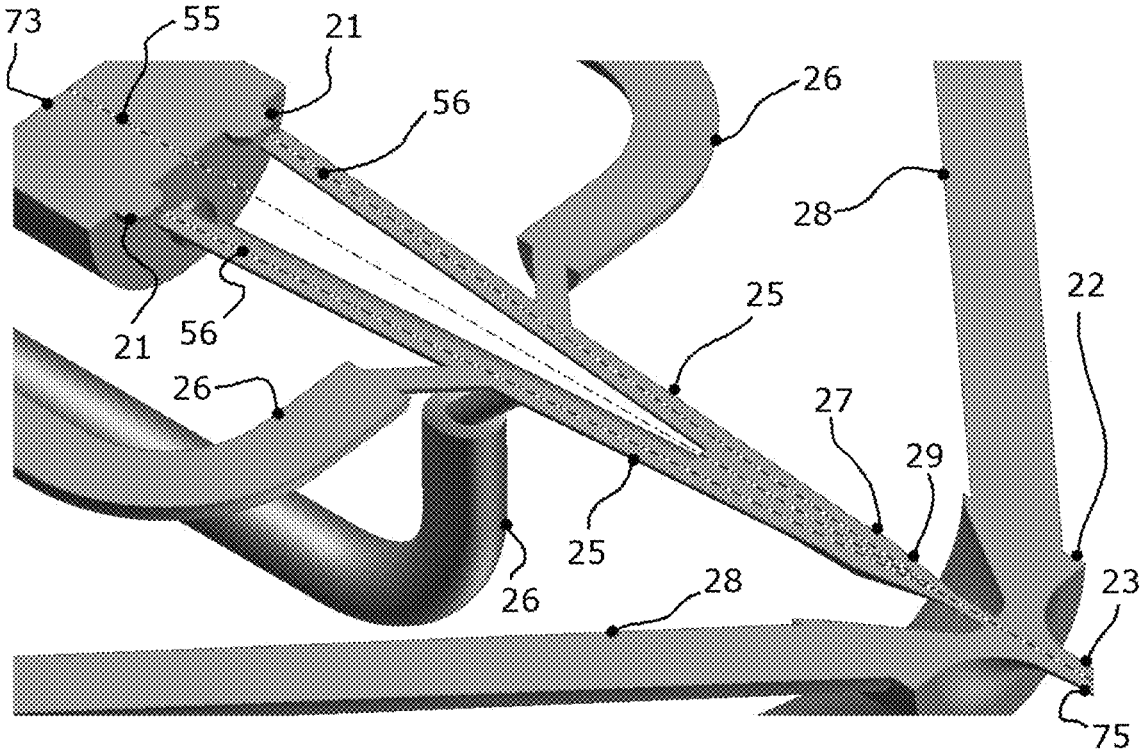

FIGS. 5*a* and 5*b* show an example of the tool design with four water jets 21, while the water jets 21 are positioned in a rotationally symmetric pattern around the tool axis 55 after the pressurized liquid infeed 73. The axes 56 of the water jets 21 and those of the separated infeed channels 25 make an angle of 15° with the tool axis 55. Each water jet 21 is connected to its own infeed channel 25 with a constant diameter which allows the high-speed liquid beam 95 to flow from a given water jet 21 into the intersection defined by the intersection 56 of the fluid jet axes 21 and the tool axis 55. Each infeed channel 25 is equipped with clean a gas 96 infeed 26, while the clean gas 96 is being automatically intaken into the separated infeed channels 25. The clean gas 96 infeeds 26 lead into the common clean gas 96 distributor 72. Four separated infeed channels 25 merge into one common channel 27 with a constant diameter. At this point, individual liquid beams 95 merge into one common beam continuing along the tool axis 55. The common channel 27 is tapered 29 before entering the mixing chamber 22. Four gas and abrasive mixture 94 infeeds 28 lead into the mixing chamber 22. The gas and abrasive mixture 94 enters the mixing chamber 22 through the infeeds 28 of the gas and abrasive mixtures 94 automatically by suction in the mixing chamber 22. The gas and abrasive 94 mixture infeeds 28 are connected to the common distributor 21 of the gas 94 and abrasive mixture. The gas and abrasive mixture 94 accelerated by the common high-speed liquid beam 95 enters the abrasive jet 23. The abrasive jet 23 is positioned in the tool axis 55 at the tool's end. At this point, further acceleration of the described mixture occurs before impacting on the cut material.

The abrasive head's supporting housing where liquid jet housing 21, tapering 29, mixing chamber housing 22 and abrasive head housing 23, is made of 17-4PH steel. The jet housing where the water jets 21 are positioned is made of 17346 steel. The tapering housing 29 is made of 1.4057 abrasion-resistant steel. The mixing chamber housing 22 is made of 1.4057 abrasion-resistant steel. The abrasive jet's housing 23 is made of hard metal. The clean gas 96 infeed 26 is made of PVC. The clean gas 96 distributor housing 72 is made is 17022 steel. The gas and abrasive mixture 94 infeed 28 is made of PVC. The gas and abrasive mixture 94 distributor housing 71 is made is 17346 steel.

In case of a tool made according to example 2, there is no gas recirculation thanks to the presence of clean gas 96 infeeds 26 into the separated infeed channels 25. The cutting and velocity profile of such tool is very efficient thanks to the presence of four liquid jets 21, with the cutting profile having a four-corner star shape, the velocity profile of such tool reaches nearly three times more uniform velocity distribution as opposed to the technology status—i.e. single-jet layout without separate clean gas 96 connections 26.

Example 3

An abrasive head with five liquid (water) jets positioned in two depths of the unit and clean gas intake through separated infeed channels and three inputs of the intaken gas and abrasive mixture into the mixing chamber.

FIG. 4 shows an example of the tool design with five water jets 21 positioned in two sets, while the water jets 21 are positioned in a rotationally symmetric two-depth pattern around the tool axis 55 after the pressurized liquid infeed 73. The axes 56 of the water jets 21 in the first set and those of the separated infeed channels 25 make an angle of 12° with the tool axis 55. The axes 56 of the water jets 21 in the second set and those of the separated infeed channels 25 make an angle of 10° with the tool axis 55. Each water jet 21 is connected to its own infeed channel 25 with a constant diameter which allows the high-speed liquid beam 95 to flow from a given water jet 21 into the intersection defined by the intersection 56 of the fluid jet axes 21 and the tool axis 55. The tool incorporates two intersection. First, the first three axes 56 of the liquid jets 21 intersect along with the tool axis 55. Then, another two axes 56 of the liquid jets 21 meet at the second point of intersection along with the 55 tool axis and the merged beam of the first three liquid jets 21. Each infeed channel 25 is equipped with clean a gas 2 infeed 26, while the clean gas 96 is being automatically intaken into the separated infeed channels 25. The clean gas 96 infeeds 26 lead into the common clean gas 96 distributor 72. Three separated infeed channels 25 merge into one common channel 27 with a constant diameter. At this point, individual liquid beams 95 merge into one common beam continuing along the tool axis 55. The common channel 27 is tapered 29 before entering the mixing chamber 22. The first intersection is located at the common channel 27, the second intersection is located at the 29 tapering respectively. At this point, all liquid beams 95 merge into one common beam continuing along the tool axis 55 into the mixing chamber 22. Four gas and abrasive mixture 94 infeeds 28 lead into the mixing chamber 22. The gas and abrasive mixture 94 enters the mixing chamber 22 through the infeeds 28 of the gas and abrasive mixtures 94 automatically by suction in the mixing chamber 22. The gas and abrasive 94 mixture infeeds 28 are connected to the common distributor 71 of the gas 94 and abrasive mixture. The gas and abrasive mixture 94 accelerated by the common high-speed liquid beam 95 enters the abrasive jet 23. The abrasive jet 23 is positioned in the tool axis 55 at the tool's end. At this point, further acceleration of the described mixture occurs before impacting on the cut material.

The abrasive head's supporting housing where liquid jets 21, tapering 29 formed by the inserted jet housing, mixing chamber housing 22 and abrasive head housing 23, is made of 17346 steel. The mixing chamber housing 22 is made of 1.4057 abrasion-resistant steel. The abrasive jet's housing 23 is made of hard metal. The clean gas 96 infeed 26 is made of 17-4PH steel. The clean gas 96 distributor housing 72 is made is 17022 steel. The gas and abrasive mixture 94 infeed 28 is made of PVC. The gas and abrasive mixture 94 distributor housing 71 is made is 17346 steel.

In case of a tool made according to example 3, there is no gas recirculation thanks to the presence of clean gas 96 infeeds 26 into the separared infeed channels 25. The cutting and velocity profile of such tool is very efficient thanks to the presence of five liquid jets 21, with the cutting profile having a five-corner star shape, the velocity profile of such tool reaches over three times more uniform velocity distribution as opposed to the technology status—i.e. single-jet layout without separate clean gas 96 connections 26.

Example 4

An abrasive head with three liquid (water) jets without clean gas intake through separated infeed channels and four inputs of the intaken gas and abrasive mixture.

FIG. 9 shows an example of the tool design with three water jets 21, while the water jets 21 are positioned in a rotationally symmetric pattern around the tool axis 55 after the pressurized liquid infeed 73. The axes 56 of the water jets 21 and those of the separated infeed channels 25 make an angle of 25° with the tool axis 55. Each water jet 21 is connected to its own infeed channel 25 with a constant diameter which allows the high-speed liquid beam 95 to flow from a given water jet 21 into the intersection defined by the intersection 56 of the fluid jet axes 21 and the tool axis 55. Three separated infeed channels 25 merge into one common channel 27 with a constant diameter. At this point, individual liquid beams 95 merge into one common beam continuing along the tool axis 55 into the mixing chamber 22, to which the common channel 27 is connected. Three gas and abrasive mixture 94 infeeds 28 lead into the mixing chamber 22. The gas and abrasive mixture 94 enters the mixing chamber 22 through the infeeds 28 of the gas and abrasive mixtures 94 by boosting. The gas and abrasive mixture 94 accelerated by the common high-speed liquid beam 95 enters the abrasive jet 23 connected to the mixing chamber. The abrasive jet 23 is positioned in the tool axis 55 at the tool's end. At this point, further acceleration of the described mixture occurs before impacting on the cut material.

The abrasive head's supporting housing where liquid jets 21, mixing chamber housing 22 and abrasive jet housing 23 contains separated infeed channels 25, common channel 27 and is made of 17-4PH steel. The mixing chamber housing 22 is made of hard metal. The abrasive jet's housing 23 is also made of hard metal. Clean gas 92 infeeds 26 made of 17022 steel are connected to the abrasive head's supporting housing. Gas and abrasive mixture 94 infeeds 28 made of 17022 steel are connected to the abrasive head's supporting housing.

Although some gas recirculation occurs in the tool made according to example 4, the cutting and velocity profile of such tool is very efficient thanks to the presence of three liquid jets 21, with the cutting profile having a three-corner star shape, the velocity profile of such tool reaches two times more uniform velocity distribution as opposed to the technology status—i.e. single-jet layout.

Example 5

An abrasive head with two liquid (water) jets and clean gas intake into the common channel and three inputs of the intaken gas and abrasive mixture.

FIG. 10 shows an example of the tool design with two water jets 21, while the water jets 21 are positioned against around the tool axis 45 after the pressurized liquid infeed 73. The water jet 21 axes 56 make an angle of 2° with the tool axis 55. Both water jets 21 lead directly into the common channel 27. At the common channel 27, individual liquid beams 95 merge into one common beam continuing along the tool axis 55 into the mixing chamber 22, to which the common channel 27 is connected. Three gas and abrasive mixture 94 infeeds 28 lead into the mixing chamber 22. The gas and abrasive mixture 94 enters the mixing chamber 22 through the infeeds 28 of the gas and abrasive mixtures 94 automatically by suction in the mixing chamber 22. The gas and abrasive mixture 94 accelerated by the common high-speed liquid beam 95 enters the abrasive jet 23 connected to the mixing chamber. The abrasive jet 23 is positioned in the tool axis 55 at the tool's end. At this point, further acceleration of the described mixture occurs before impacting on the cut material.

The abrasive head's supporting housing where liquid jets 12, mixing chamber housing 22 and abrasive jet housing 23 contains common channel 27 and is made of 17-4PH steel. The mixing chamber housing 22 is made of hard metal. The abrasive jet's housing 23 is also made of hard metal. Clean gas 96 infeeds 26 made of 17022 steel are connected to the abrasive head's supporting housing. Gas and abrasive mixture 94 infeeds 28 made of 17-4PH steel are connected to the abrasive head's supporting housing.

The cutting and velocity profile of such tool is very efficient thanks to the presence of two liquid jets 21, with the cutting profile having a three-corner star shape, the velocity profile of such tool reaches two times more uniform velocity distribution as opposed to the technology status—i.e. single-jet layout.

LIST OF MARKS FOR TERMS

21—liquid jet
22—mixing chamber
23—abrasive jet
25—infeed channel
26—clean gas 96 infeeds
27—common channel
28—infeeds of gas and abrasive mixture 94
29—common channel 27 tapering
55—tool axis
56—liquid jet 21 axis

65—mixture velocity profile shape in a single-jet abrasive head
66—mixture velocity profile shape in a multi-jet abrasive head
71—distributor of gas and abrasive mixture 94
72—clean gas 96 distributor
73—pressurized liquid infeed
75—cylindrical section of abrasive jet 23
92—common liquid beam
94—mixture of gas and abrasive
95—liquid beam
96—clean gas

APPLICABILITY IN INDUSTRY

Cleaning materials, removing material surfaces, splitting or cutting materials by liquid beam enriched with abrasive solid particles.

The invention claimed is:

1. A multi jet abrasive head containing a mixing chamber (22) equipped with infeeds (28) of a gas and abrasive mixture (94) connected to an abrasive jet (23) characterized by containing at least one set of two liquid jets (21) positioned around a tool axis (55), while each liquid jet (21) leads into a common channel (27) connected to a mixing chamber (22), while a liquid jet (21) axis (56) makes an angle of 0.5° to 45° with the tool axis (55), while the liquid jets (21) positioned in a set are at equal distances from the tool axis (55), and wherein each liquid jet has the same angle as the other liquid jet in a set, and wherein the liquid jets are positioned in a rotationally symmetric pattern around the tool axis (55) or against each other; wherein the axes (56) of individual liquid jets (21) have a common intersection with the tool axis (55) in the common channel (27) before entering the mixing chamber (22) in a flow direction.

2. The multi-jet abrasive head according to claim 1 characterized by an infeed channel (25) located between a liquid jet (21) of the two liquid jets and the common channel (27), while the liquid jet (21) axis (56) of the liquid jet of the two liquid jets is parallel to the infeed channel axis (25).

3. The multi-jet abrasive head according to claim 2 characterized by the infeed channel axis (56) and the liquid jet (21) axis (56) of the liquid jet of the two liquid jets making an angle of 2° to 25° with the tool axis (55).

4. The multi jet abrasive head according to claim 2, wherein the infeed channel comprises separated infeed channels (25) being equipped with clean gas (96) infeeds (26).

5. The multi-jet abrasive head according to claim 1 characterized by containing a single set of three liquid jets (21).

6. The multi-jet abrasive head according to claim 1 characterized by containing a single set of four liquid jets (21).

7. The multi-jet abrasive head according to claim 1 characterized by the common channel (27) being equipped with a clean gas (96) infeed (26).

8. The multi-jet abrasive head according to claim 1 characterized by the common channel (27) being tapered (29) before entering the mixing chamber (22).

9. The multi-jet abrasive head according to claim 8 characterized by the common channel (27) tapering (29) formed by an inserted jet.

10. The multi-jet abrasive head according to claim 8 characterized by an output diameter (29) of the common channel tapering being smaller than the diameter of a cylindrical section (75) of the abrasive jet (23).

11. A multi jet abrasive head containing a mixing chamber (22) equipped with infeeds (28) of the gas and abrasive mixture (94) connected to an abrasive jet (23) characterized by a first set of liquid jets and a second set of liquid jets (21) positioned around a tool axis (55), while each liquid jet (21) leads into a common channel (27) connected to a mixing chamber (22), while a liquid jet (21) axis (56) makes an angle of 0.5° to 45° with the tool axis (55), while the liquid jets (21) positioned in a set are at equal distances from the abrasive jet's output (23) under the same angle between the liquid jet (21) axis (56) and the tool axis (55), they are positioned in a rotationally symmetric pattern around the tool axis (55) or against each other with a common intersection of the liquid jet (21) axes (56) and the tool axis (55) in a common channel (27) before entering the mixing chamber (22) in the flow direction; wherein the first set of liquid jets contains three liquid jets (21) positioned around the tool axis (55) in a rotationally symmetric pattern and the second set of liquid jets (21) contains two jets (21) positioned against each other with the second set being closer to the abrasive jet (23) output than the first set.

* * * * *